US006379609B1

(12) United States Patent
Stummer

(10) Patent No.: US 6,379,609 B1
(45) Date of Patent: Apr. 30, 2002

(54) PROCESS FOR CONTROLLING THE AMOUNT OF METAL METERED

(75) Inventor: Friedrich Georg Stummer, Fellbach (DE)

(73) Assignee: Muller Weingarten AG, Weingarten (DE)

( * ) Notice: Subject to any disclaimer, the term of this patent is extended or adjusted under 35 U.S.C. 154(b) by 0 days.

(21) Appl. No.: 09/649,058

(22) Filed: Aug. 29, 2000

(30) Foreign Application Priority Data

Aug. 30, 1999 (DE) ..... 199 41 430

(51) Int. Cl.[7] ..... C21B 7/12
(52) U.S. Cl. ..... 266/45; 266/91; 266/94
(58) Field of Search ..... 266/93, 94, 95, 266/91, 44.45; 165/63

(56) References Cited

U.S. PATENT DOCUMENTS

| | | | | |
|---|---|---|---|---|
| 3,632,099 A | * | 1/1972 | Lord | 266/94 |
| 5,388,633 A | | 2/1995 | Mercer, II et al. | |
| 5,462,107 A | * | 10/1995 | Hasegawa et al. | 164/63 |
| 5,643,528 A | | 7/1997 | Le Gras | |

FOREIGN PATENT DOCUMENTS

| | | |
|---|---|---|
| DE | 41 12 753 A1 | 10/1992 |
| DE | 42 39 558 A1 | 5/1994 |
| DE | 44 03 285 A1 | 8/1995 |
| EP | 0 014 301 b1 | 8/1980 |
| EP | 0 051 310 B1 | 5/1982 |
| EP | 0 594 961 A1 | 5/1994 |
| EP | 0 600 324 A1 | 6/1994 |

OTHER PUBLICATIONS

Measuring and Control Systems for high quality in die casting and New family of preheating devices, Aluminum, 74, Jan. 1988, 3, p. 122.
Dosieranlage für Aluminium an einer Druckguss–maschine, Giesserei–Erfahrungsaustausch, Jul. 1994, pp. 321–322.
New–generation piston lubricant, Aluminum, 73, Jan. 1997, 6, pp. 388–389.
Frey, Rolf, System zur statistischen Prozessüberwachung beim Druckgiessen, Giesserel 80, Apr. 1993, No. 8–19, pp.247–252.
Konzeption einer neuen Dosiersteuerung, Giesserei 77, Feb. 1990, No. 3–5, pp. 77–78.

* cited by examiner

*Primary Examiner*—Scott Kastler
(74) *Attorney, Agent, or Firm*—Hogan & Hartson, LLP

(57) ABSTRACT

The invention relates to a process for controlling casting parameters and in particular to the control of the metering of the molten metal in a casting chamber of a vacuum die-casting machine. Measurement devices connected to a computer determine the volume and condition of the molten material. An evacuation device and a vacuum valve are controlled in the form of a control circuit.

9 Claims, 1 Drawing Sheet

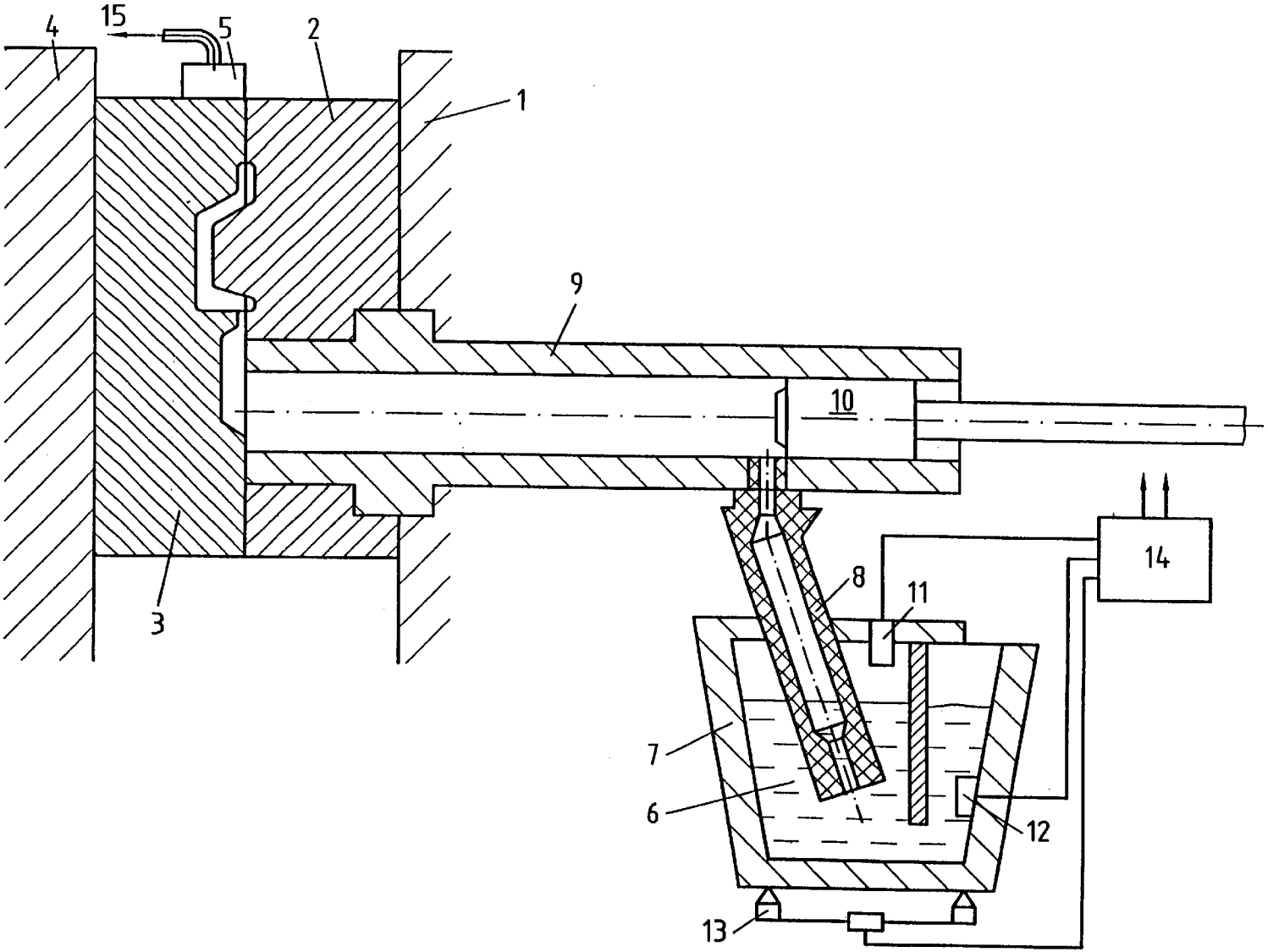
1
2
3
4
5
6
7
8
9
10
11
12
13
14
15

PROCESS FOR CONTROLLING THE AMOUNT OF METAL METERED

BACKGROUND OF THE INVENTION

1. Field of the Invention

The invention relates to a process for controlling the metering of metal in die-casting machines in which the metering is effected by pressure reduction.

2. Discussion of the Related Art

EP 0,051,310 B1 has disclosed a die-casting machine which operates using the so-called vacuum die-casting process. In this process, the molten metal is sucked out of a holding furnace, via an intake pipe, into the casting chamber by means of pressure reduction, the pressure reduction being applied via an extraction duct in the mold-parting plane of the casting die. The pressure reduction applied to the casting die is to fulfill substantially 2 functions: Firstly that of degassing the casting chamber and the die and secondly that of sucking the amount of metal which is required to produce the parts out of the holding furnace into the casting chamber. The metering accuracy represents an essential factor for the quality of the castings. A high metering accuracy also requires suitable control of the machine parameters in order to achieve the desired process reliability.

A proven process for good metering accuracy is disclosed by DE 41 12 753 A1. By means of a measuring device, the filling level in the casting chamber is measured by a sensor. However, this process is only suitable for cold-chamber die-casting machines, in which the metering is effected, for example, by a metering ladle into an opening of the casting chamber. The function and the measurement accuracy of a sensor for level measurement is described extensively in EP 0,014,301. A die-casting machine which is operated using the vacuum process operates in the manner of a closed system, i.e. there is no external metering. A metering aperture in the casting chamber, as described in DE 41 12 753, which is generally directed upward, is not present, and the procedure of measuring the filling level in the casting chamber consequently cannot be employed without problems.

SUMMARY OF THE INVENTION

The essence of the invention consists in further developing the process from DE 41 12 753 A1, in the name of the inventor, in such a way that it is possible to use this .process in vacuum die-casting machines. Since a level measurement in the casting chamber cannot be carried out easily, the corresponding measurement is carried out in the holding furnace. For this purpose, a probe is fitted in the holding furnace to determine the filling level of the molten material and the change in this level during the metering phase. Since the invention is not restricted to measuring a level change, but rather proposes an entire control circuit, an actual value is formed from the signal from the probe and this value is compared to a desired value. The desired value is determined from the parameters required for optimum production of the parts and is provided with permissible tolerances. The result of the comparison of the desired value and of the actual value is processed in a computer in such a manner that metering parameters, such as for example pressure reduction and metering time, can be set for optimum production of castings. The computer contains mathematical and physical formulae and rules relating to this control process, and these formulae and rules are supplemented by specialist knowledge from the casting sector. In this way, the computer is able to determine the optimum process parameters at any given time and to transmit the values to the machine control unit in order to carry out control operations. The level measurement may be supplemented by further measurement parameters.

By way of example, the filling level of the furnace can be determined using the furnace weight, or the temperature-dependent viscosity of the molten metal can be determined by suitably evaluating a temperature measurement. Monitoring of the suction time is also provided for at a vacuum valve. If a desired value is exceeded, this is an indication of an operating fault or of incorrect production of parts, if the required metering quantity in this period has not been confirmed by a level sensor. All these measures serve to increase quality and therefore to minimize reject parts. Since the entire casting process is characterized by a large number of influences, it is important to control the individual parameters reliably. For example, not only are the geometry and microstructure quality of the casting dependent on the metering accuracy, but, to achieve them, some setting parameters of the die-casting machine are too. By way of example, this applies to the changeover points of the pressure- or displacement-dependent connection of the individual casting phases, and knowledge of the temperature and viscosity of the molten metal is also required to control the casting rate and the specific casting pressures. Introducing specialist knowledge from the die-casting sector in combination with the use of a computer also allows significantly more complex analysis of the actual data and their suitability to be carried out. For example, a molten material temperature which is supposedly too low can still lead to good parts by increasing the pressure reduction and therefore reducing the metering time. Specialist knowledge from the die-casting sector also includes knowledge of the fluid dynamics of the molten metal. Therefore, in the suction and metering phase a high vacuum of, for example, 50 mbar is desired, with the result that favorable inflow rates of approx. 4÷10 m/s occur in the region of a restrictor which is arranged in the inflow region of the intake pipe.

A high level of process reliability can be achieved with little outlay using the proposed metering process. Advantageous developments and improvements of the process according to the invention are given in the subclaims.

Further details and advantages are explained in more detail in the following description of an exemplary embodiment.

BRIEF DESCRIPTION OF THE DRAWINGS

The FIGURE shows a partial illustration of a vacuum die-casting machine in accordance with the present invention.

DETAILED DESCRIPTION OF THE PREFERRED EMBODIMENT

The FIGURE shows a partial illustration of a vacuum die-casting machine. The fixed die half 2 is attached to the fixed platen 1 illustrated. The moving die half 3 is attached to the moving platen 4. The die halves 2, 3 are shown in the closed position. The vacuum valve 5, which controls the degassing and metering, is attached to the moving die half 3. The vacuum valve 5 is actively connected to an evacuation device 15, which is not shown in more detail. The molten material 6 is situated in the holding furnace 7. The molten material 6 is sucked in, by the controllable vacuum, via the suction pipe 8 into the casting chamber 9. The suction pipe 8 is designed in such a way that there is a restriction point or reduced cross section on the inflow side. The extent to which the cross-section is reduced depends on the desired intake volume and therefore the weight of the parts. In particular, a cross section which in each case ensures optimum flow conditions or inflow rates of approx. 4 to 10 m/s is selected. The actual situated in the casting chamber 9 into the die cavity of the die 2, 3 is effected by advancing casting plunger 10. The casting plunger speed is controllable and dependent on the process steps:

1. Passing over the intake opening at a low speed;
2. High speed for filling the die; and
3. Speed reducing to zero, under high pressure, in order to compact the molten material in the die cavity.

The vacuum is the defining criterion for the metering of the molten material 6 in the casting chamber 9, the intake time being controlled via the vacuum valve 5. Various parameters, such as for example the level of the pressure reduction, the metering time as a function of the control of the vacuum valve 5, the level of the molten material 6 in the holding furnace 7, the intake level of the molten material 6 with respect to the installation level of the casting chamber 9, the temperature of the molten material 6, partly as an indication of the viscosity, influence the metering quantity.

To determine influencing parameters, by way of example actual value sensors 11, 12, 13 are indicated in the holding furnace 7. Thus, probe 11 can determine the particular level and its change during metering. The temperature of the molten material can be measured by measurement sensor 12, and the weight of the pool of molten material is measured by weighing device 13. These measurement sensors are connected to a computer 14 for analysis and processing of the actual values. In addition to the comparison of desired and actual values, mathematical, physical, casting technology and machine-specific information is used in the computer 14 to determine the optimum control parameters. These parameters are used to control the vacuum device and therefore to achieve a high level of metering accuracy. As an output parameter from computer 14 it is thus possible, for example, to control the opening time of the vacuum valve 5 or the level of the pressure reduction.

In addition to the above, the computer also determines whether the vacuum device is operated erroneously or whether parts of the machine are scrap when the metering time at the vacuum valve 5 deviates with respect to the volume of molten material 6 sucked into the casting chamber 9.

What is claimed is:

1. A process for controlling the metering of molten metal in a vacuum die-casting machine, wherein the vacuum die-casting machine includes a vacuum valve, the molten metal is held in a holding furnace and the molten metal is sucked into a casting chamber, the process comprising the steps of:

measuring at least one actual value of the molten metal inside the holding furnace;

comparing the measured actual value with a desired value; and determining at least one optimum control parameter based on the comparison result to achieve a high level of metering accuracy;

wherein the metering is effected by a pressure reduction in the vacuum die-casting machine and by controlling the vacuum valve and wherein the at least one actual value includes a value indicating a filling level of the molten metal in the holding furnace and a value indicating a weight of the molten metal in the holding furnace.

2. The process according to claim 1, wherein the desired value is stored in a computer.

3. The process according to claim 1, wherein the vacuum valve controls a flow time and a flow volume of the molten metal.

4. The process according to claim 1, wherein the value indicating a filling level of the molten metal sucked in the holding furnace is measured by a level sensor.

5. The process according to claim 1, further comprising measuring the temperature of the molten metal in the holding furnace by use of a temperature sensor.

6. The process according to claim 1, wherein the value indicating a weight of the molten metal in the holding furnace is measured by a weighing sensor.

7. The process according to claim 1, wherein the at least one optimum control parameter controls one of pressure reduction, a switching function of the vacuum valve and a movement of a casting plunger.

8. The process according to claim 1, further comprising the step of:

analyzing whether parts of the machine are scrap when a metering time at the vacuum valve deviates with respect to the volume of the molten material sucked into the casting member.

9. The process according to claim 1, wherein the vacuum valve controls the rate at which the molten metal flows into a suction pipe to be 4 to 10 m/s.

* * * * *